US011846139B2

(12) United States Patent
Glaesman et al.

(10) Patent No.: US 11,846,139 B2
(45) Date of Patent: Dec. 19, 2023

(54) CARBON-SWELLABLE SEALING ELEMENT

(71) Applicant: Halliburton Energy Services, Inc., Houston, TX (US)

(72) Inventors: Chad William Glaesman, Singapore (SG); Michael Linley Fripp, Singapore (SG); Nam Thanh Vu, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/186,030

(22) Filed: Mar. 17, 2023

(65) Prior Publication Data

US 2023/0228166 A1 Jul. 20, 2023

Related U.S. Application Data

(63) Continuation of application No. 17/453,698, filed on Nov. 5, 2021, now Pat. No. 11,634,962.

(51) Int. Cl.

| | |
|---|---|
| ***E21B 33/12*** | (2006.01) |
| ***E21B 21/00*** | (2006.01) |
| ***E21B 23/06*** | (2006.01) |
| ***E21B 33/134*** | (2006.01) |

(52) U.S. Cl.

CPC ..... *E21B 33/1208* (2013.01); *E21B 21/003* (2013.01); *E21B 23/06* (2013.01); *E21B 33/134* (2013.01)

(58) Field of Classification Search

CPC .... E21B 33/1208; E21B 21/003; E21B 23/06; E21B 33/134

See application file for complete search history.

(56) References Cited

U.S. PATENT DOCUMENTS

| | | | | |
|---|---|---|---|---|
| 10,487,612 | B2 | 11/2019 | Muthusamy et al. | |
| 2003/0008577 | A1* | 1/2003 | Quigley | F16L 9/18 441/133 |
| 2005/0016740 | A1* | 1/2005 | Aldaz | E21B 43/08 166/387 |
| 2009/0200043 | A1* | 8/2009 | Olinger | E21B 33/1208 166/387 |
| 2009/0205816 | A1* | 8/2009 | De | C08L 23/16 507/224 |
| 2010/0163252 | A1 | 7/2010 | Regnault De La Mothe et al. | |
| 2011/0254227 | A1* | 10/2011 | McKenzie | F16J 15/168 277/300 |

(Continued)

FOREIGN PATENT DOCUMENTS

| | | | |
|---|---|---|---|
| EP | 2404884 | A1 | 1/2012 |

*Primary Examiner* — Steven A MacDonald

(74) *Attorney, Agent, or Firm* — Sheri Higgins Law, PLLC; Sheri Higgins

(57) ABSTRACT

Methods of capturing carbon dioxide in a wellbore can include installing a sealing element in the wellbore. The sealing element swells in the presence of carbon dioxide and can be used for capturing the carbon. The sealing element can include a carbon-swelling material, such as a carbon-swelling polymers, metal-based materials, or combinations of elastomeric polymers and metal-based materials. The sealing element can also include combinations of different carbon-swelling materials, fillers or other compounds, and materials that are not carbon swellable. The sealing element can create a seal, form an anchor, or create a seal and form an anchor in the wellbore after swelling.

20 Claims, 3 Drawing Sheets

(56) References Cited

U.S. PATENT DOCUMENTS

| | | | | |
|---|---|---|---|---|
| 2012/0090857 | A1* | 4/2012 | Welch | E21B 33/1208 166/387 |
| 2014/0060836 | A1* | 3/2014 | Daou | C04B 28/02 166/293 |
| 2014/0090844 | A1* | 4/2014 | Daou | C09K 8/92 166/300 |
| 2014/0090895 | A1* | 4/2014 | Daou | C09K 8/035 166/305.1 |
| 2015/0083415 | A1* | 3/2015 | Monroe | E21B 43/16 507/224 |
| 2015/0166874 | A1* | 6/2015 | Daou | C09K 8/48 524/5 |
| 2015/0167424 | A1* | 6/2015 | Richards | C09K 8/487 166/386 |
| 2016/0040038 | A1* | 2/2016 | Cornelissen | C09D 175/04 427/386 |
| 2016/0289532 | A1 | 10/2016 | Muthusamy et al. | |
| 2017/0138149 | A1 | 5/2017 | Muthusamy et al. | |
| 2018/0252070 | A1* | 9/2018 | Zhu | C08K 7/02 |
| 2019/0211642 | A1* | 7/2019 | Ruckert | E21B 33/128 |
| 2019/0292435 | A1 | 9/2019 | Goodman et al. | |
| 2019/0316025 | A1* | 10/2019 | Sherman | E21B 33/138 |
| 2020/0080401 | A1* | 3/2020 | Sherman | E21B 43/086 |
| 2021/0254429 | A1* | 8/2021 | Ruckert | E21B 33/14 |
| 2022/0002612 | A1* | 1/2022 | Sherman | C09K 8/467 |

* cited by examiner

CARBON-SWELLABLE SEALING ELEMENT

TECHNICAL FIELD

A variety of sealing elements can be used to restrict fluid flow within a wellbore. The sealing element can swell in the presence of a fluid that has a high carbon content. The sealing element can swell in the presence of carbon dioxide. The sealing element can be used to capture and store carbon dioxide.

BRIEF DESCRIPTION OF THE FIGURES

The features and advantages of the various embodiments will be more readily appreciated when considered in conjunction with the accompanying figures. The figures are not to be construed as limiting any of the embodiments.

DETAILED DESCRIPTION

Figure 1:
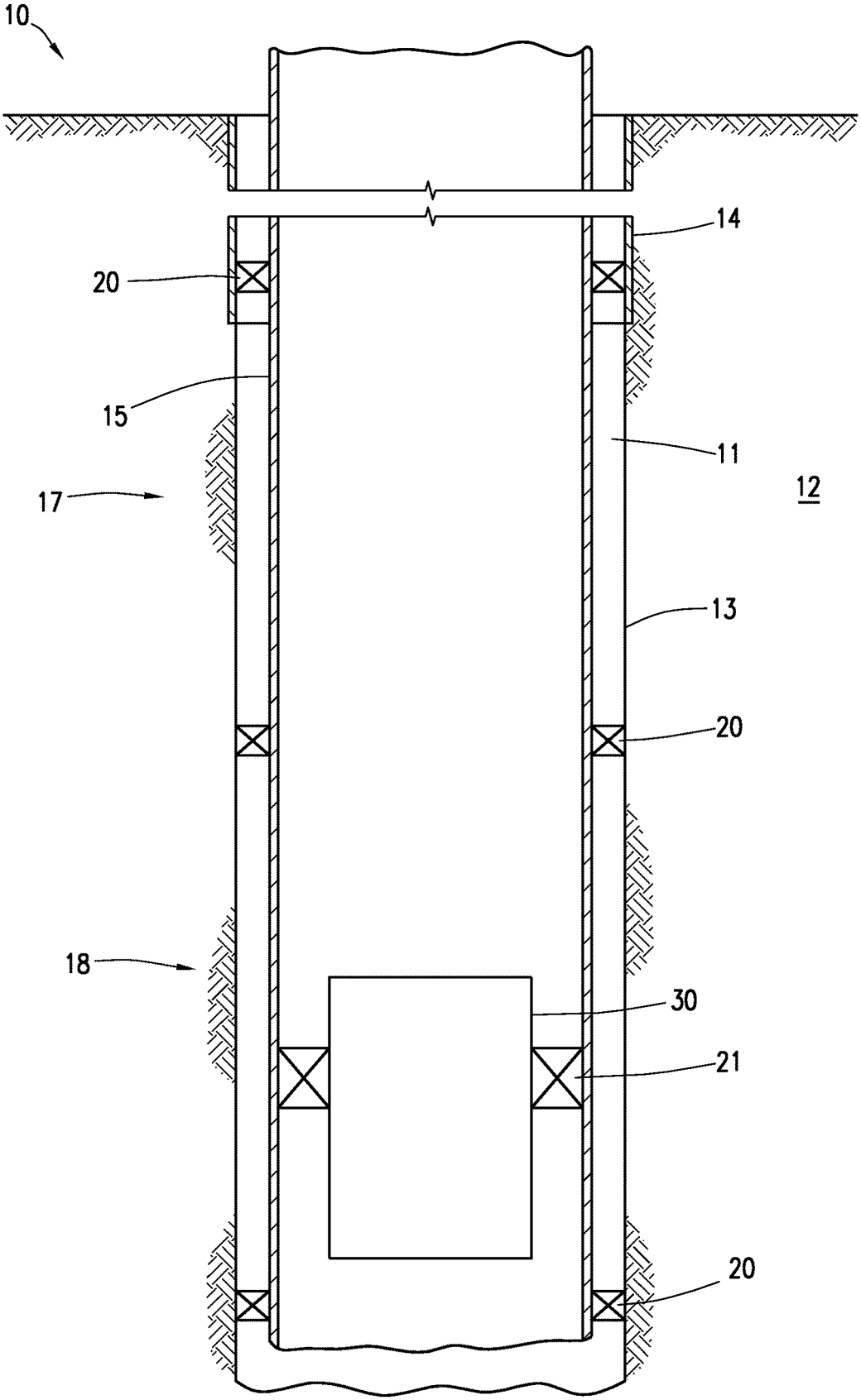
FIG. 1 is a schematic illustration of a well system according to certain embodiments.

The sequestration of carbon dioxide can be performed in some subterranean formations. In the oil and gas industry, which is interested in subsurface carbon sequestration, a subterranean formation appropriate for the injection of carbon dioxide is referred to as a reservoir. A reservoir can be located under land or offshore. Reservoirs are typically located in the range of a few hundred feet (shallow reservoirs) to a few tens of thousands of feet (ultra-deep reservoirs). In order for the subsurface sequestration of carbon dioxide to occur, a wellbore is drilled into a reservoir or adjacent to a reservoir. A fluid is then pumped into the wellbore. A fluid that is pumped from the surface into a reservoir is called an injection fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid, gas, or a supercritical fluid. A homogenous fluid has only one phase, whereas a heterogeneous fluid has more than one distinct phase. A colloid is an example of a heterogeneous fluid. A heterogeneous fluid can be a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the term "base fluid" means the solvent of a solution or the continuous phase of a heterogeneous fluid and is the liquid that is in the greatest percentage by volume of a treatment fluid. As used herein, the term "carrier fluid" means a liquid that can transport another fluid downhole. A carrier fluid can be in a smaller concentration than the other fluid.

A well can include, without limitation, an oil-, gas-, or water-production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to, the space between the wellbore wall and the outside of a tubing string in an open-hole wellbore; the space between the wellbore wall and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. One or more zones of the formation can be isolated within the wellbore via the use of an isolation device. An isolation device can be used for zonal isolation and functions to block fluid flow within a tubular, such as a casing, or within an annulus. The blockage of fluid flow prevents the fluid from flowing across the isolation device in any direction (either downstream or upstream) and isolates the zone of interest. As used herein, the relative term "downstream" means at a location further away from a wellhead. As used herein, the relative term "upstream" means at a location closer to the wellhead. In this manner, treatment techniques can be performed within the zone of interest.

Common isolation devices include, but are not limited to, a bridge plug, a packer, a plug, and cement. Zonal isolation can be accomplished by introducing the isolation device into the desired portion of the wellbore. The isolation device can include a sealing element. For example, in one embodiment a bridge plug is composed primarily of slips, a plug mandrel, a setting device, and a sealing element, and in another embodiment a packer generally consists of a sealing device, a holding or setting device, and an inside passage for fluids. The outer diameter (OD) of the sealing element can be caused to expand, wherein after expansion, the OD of the sealing element engages with the inside wall of the tubular or of the formation. By engaging with the inside wall, the isolation device functions to block fluid flow across the expanded sealing element. Zonal isolation can also be accomplished; for example, by introducing a plug into a tubing string or casing to restrict fluid flow through the inside of the tubing string or casing.

Sealing elements can be mechanically set or can set by swelling in the presence of a swelling fluid. For example, some sealing elements can swell in the presence of water and other elements can swell in the presence of a liquid hydrocarbon.

Carbon dioxide is emitted into the atmosphere by a variety of mechanisms. For example, in 2019, approximately 43 billion tons of carbon dioxide were emitted worldwide. The need for reducing carbon emissions worldwide has only increased due to global warming. One technique to reduce the amount of carbon emitted is called carbon capture. Carbon capture is the process of transporting and storing or just storing carbon dioxide before it is emitted into the atmosphere.

Carbon dioxide ($CO_2$) is often present in produced wellbore fluids. Typically, the carbon dioxide is separated from the desirable products, for example methane, in the produced fluids during processing. Current oil and gas operations actively avoid carbon-absorbing materials because they are sensitive to explosive gas decompression and the strong solvent properties of the liquid phase, and super critical $CO_2$ ($SCCO_2$) can plasticize polymers and lead to changes in the glass transition temperature (Tg). Moreover, swellable sealing elements can be damaged by the carbon dioxide in the produced fluids. For example, if carbon dioxide is trapped in the sealing element, then changes in pressure or temperature can cause the carbon dioxide to be quickly released from the sealing element and can lead to cracks in the element and even portions of the element breaking free. This damage can result in decreased integrity of the sealing element and failure, such that the sealing element no longer functions as a seal and carbon dioxide can be released into the atmosphere.

Thus, there is a long-felt need to prevent release of carbon dioxide during oil and gas operations. There is also a long-felt need to be able to capture and store carbon dioxide in a wellbore. It has been discovered that sealing elements that swell in the presence of carbon dioxide can be placed within a wellbore. In some applications, the carbon dioxide can be captured by the sealing elements and prevented from being released into the atmosphere. In other applications, the carbon dioxide enhances the performance of the sealing elements and prevents the sequestered carbon dioxide from returning to the atmosphere.

According to any of the embodiments, a method of capturing carbon dioxide in a subterranean formation can include installing a sealing element in a wellbore that penetrates the subterranean formation, wherein the sealing element swells in the presence of carbon dioxide to create the seal; and contacting the sealing element with carbon dioxide.

According to any of the embodiments, a well system can include a wellbore that penetrates a subterranean formation; a tubing string located within the wellbore; and a sealing element located adjacent to the tubing string, wherein the sealing element swells in the presence of carbon dioxide.

The various disclosed embodiments apply to the methods and systems without the need to repeat the various embodiments throughout. As used herein, any reference to the unit "gallons" means U.S. gallons.

Turning to the Figures, FIG. 1 depicts a well system 10. The well system 10 can include at least one wellbore 11. The wellbore 11 can penetrate a subterranean formation 12. The wellbore 11 comprises a wellbore wall 13. The subterranean formation 12 can be a portion of a reservoir or adjacent to a reservoir. The wellbore 11 can include a casing 14. The wellbore 11 can include only a generally vertical wellbore section or can include only a generally horizontal wellbore section. One or more tubing strings, for example, a tubing string 15, can be installed in the wellbore 11. The tubing string 15 can provide a conduit for fluids to travel from the formation to the surface of the wellbore 11 or vice versa. A downhole tool, for example, a packer assembly 20, can be run into the wellbore 11.

The packer assembly 20 can provide an annular seal between the outside of the tubing string 15 and the inside of the casing 14 or wellbore wall 13 to define a first zone 17 and a second zone 18 of the subterranean formation 12. The packer assembly 20 can also be used between the outside of a first tubing string and the inside of a second tubing string (not shown). The packer assembly 20 can be used to seal or "pack off" the wellbore 11 such that the flow path of fluids in the wellbore 11 can be redirected.

It should be noted that the well system 10 illustrated in the drawings and described herein is merely one example of a wide variety of well systems in which the various embodiments can be utilized. For instance, the wellbore 11 can have a horizontal section and a vertical section. It should be clearly understood that the various embodiments are not limited to any of the details of the well system 10, or components thereof, depicted in the drawings or described herein. Furthermore, the well system 10 can include other components, such as production tubing, screens, and other isolation devices not depicted in the drawings. According to any of the embodiments, one or more packers can be introduced into multi-zone completions, between an inner and outer string, and in a vertical and/or horizontal section of the wellbore 11. The packer assembly 20 can be installed in the wellbore 11 during oil or gas operations, such as well completion operations or well testing operations. The packer assembly 20 can be located in a cased wellbore section or an open-hole wellbore section. There can also be more than one packer assembly 20 located within the wellbore in a variety of locations; for example, in cased sections, open-hole sections, or combinations thereof.

Figure 2:
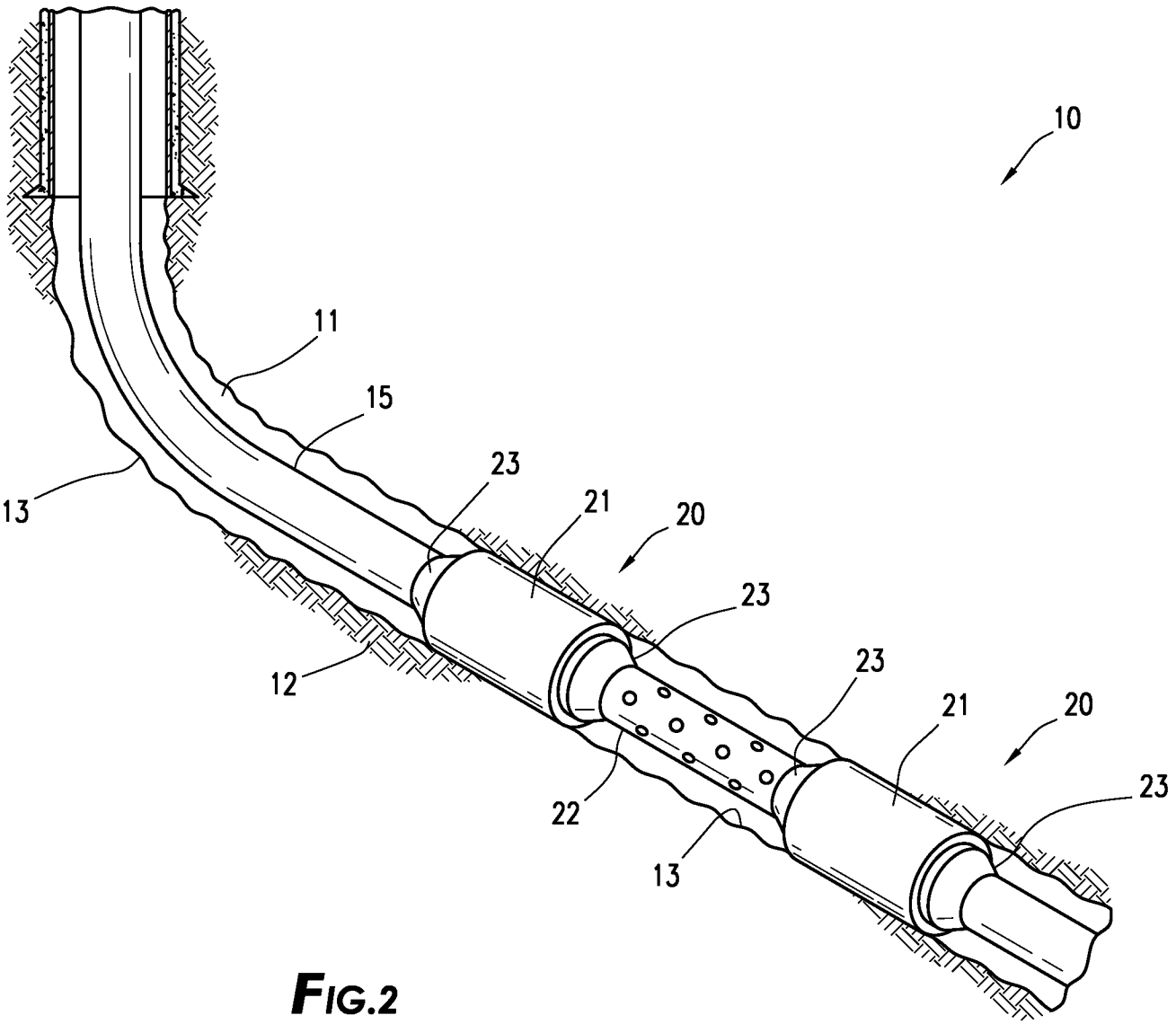
FIG. 2 is an illustration of the well system showing a sealing element with a carbon-swelling material according to certain embodiments.

FIG. 2 illustrates a packer assembly 20 when run to a desired depth in the subterranean formation 12. The packer assembly 20 can include a sealing element 21. The sealing element 21 can be located circumferentially around the outside of the packer assembly 20. The sealing element 21 can be axially constrained on the top and/or bottom; for example, via two end rings 23 such that the sealing element 21 expands in a radial direction only. The sealing element 21 swells in the presence of carbon dioxide. As the swellable material swells, it can expand radially and seals the annulus, for example as a packer assembly, or inside of the tubing string, for example as a plug 30 of FIG. 1. As shown in FIG. 2, at the desired setting depth, the sealing element 21 has been contacted with carbon dioxide and the sealing element 21 has swelled to contact the wellbore wall 13 to form an annular seal. When used in an annulus between the outside of the tubing string 15 and the inside of a casing 14, after swelling, the sealing element 21 can contact the inside of the casing 14 to form an annular seal. Multiple packer assemblies 20 can be used in a variety of locations within the wellbore 11. The packer assembly 20 can also be used to form an annular seal between two distinct conduits 22.

It is to be understood that while the various embodiments can refer to a "packer assembly," other downhole tools, such as sliding sleeves and plugs (e.g., bridge plugs, wiper plugs, and frac pack plugs), are not to be excluded. For example, as shown in FIG. 1, a plug 30 can be installed within the tubing string 15 or a casing 14. The plug 30 can include one or more sealing elements 21 that after expanding in the presence of carbon dioxide, contacts the inside of the tubing string 15 as shown and prevent fluid flow past the plug 30.

The sealing element 21 can also be located on other downhole tools, such as sliding sleeves, in the form of O-rings or gaskets or gland seals.

The methods include installing the sealing element into a wellbore. The sealing element swells in the presence of carbon dioxide. As used herein, the term "swell" and all grammatical variations thereof means an expansion in volume from a pre-swelled volume. As used herein, the sealing element can "swell" by a variety of mechanisms and does not mean an expansion in volume due only to imbibing carbon dioxide. The mechanism by which the sealing element "swells" can be due to any of the following: adsorption of the carbon dioxide where the carbon-based atoms/molecules permeate the sealing element or adhere to the sealing element's surface, a chemical reaction, through grafting, through impregnation, through complexation, or through incorporation. By way of example, carbon dioxide can be adsorbed within the pores of the sealing element material and swells the sealing material without changing the chemistry of the sealing material. By way of another example, carbon dioxide can chemically react with the sealing material and the resultant product of the chemical reaction has a larger volume than the original volume of the sealing material.

The expansion in volume can occur in one or more dimensions. By way of example, if the sealing element is located around a packer mandrel, the outer diameter (OD) of the sealing element may expand or the OD and the height may expand. This can be because the inner diameter (ID) of the sealing element is constrained from expanding by the packer mandrel; thus, only the OD or the OD and the height can expand.

According to any of the embodiments, the sealing element swells at least 20%, 120%, or 300% in volume. The sealing element can swell a sufficient volume such that a seal is created at the location of the sealing element in the wellbore. According to any of the embodiments, the sealing element does not create a seal until the sealing element has swelled in the presence of carbon dioxide. For example, the sealing element can swell a sufficient volume such that the sealing element creates a seal; for example, the OD of the sealing element engages with the inner diameter of a tubing string, casing, or wellbore wall to create the seal after exposure to carbon dioxide whereby fluid is prevented or substantially restricted from flowing past the sealing element. According to any of the embodiments, the sealing element prevents substantially all of a fluid from flowing past the sealing element after the sealing element has swelled. The sealing element can swell at least a sufficient volume such that the sealing element creates a seal in the wellbore. While the sealing element can prevent substantially all of a fluid from flowing past the sealing element, it is to be understood that it is possible that some minute and unintentional quantities of fluid may flow past the sealing element. Such trace amounts of fluid may unintentionally flow past the sealing element. However, these trace amounts should not be so great as to render the swelled sealing element ineffective as a seal. The sealing element can also swell to form an anchor in the wellbore without creating a seal or can form an anchor and create a seal.

The sealing element can be made of a carbon-swellable polymer. The polymer can be a solid material, or it can be formed as a gel, including a hydrogel. A polymer is a molecule composed of repeating units, typically connected by covalent chemical bonds. A polymer is formed from monomers. During the formation of the polymer, chemical groups and/or protons can be cleaved from monomers using initiators and/or catalysts to create a reactive monomer site known as the monomer residue. The monomer residue initiates a series of cascading reactions between reactive monomer sites and other monomers leading first to macromolecules and ultimately forming the polymer through polymerization mechanisms like addition or condensation reactions. The polymer can also contain pendant functional groups connected to the backbone at various locations along the backbone. Polymer nomenclature is generally based upon the type of monomer residues comprising the polymer. A polymer formed from one type of monomer residue is called a homopolymer. A polymer formed from two or more different types of monomer residues is called a copolymer. The number of repeating units of a polymer is referred to as the chain length of the polymer. The number of repeating units of a polymer can range from approximately 11 to greater than 10,000. In a copolymer, the repeating units from each of the monomer residues can be arranged in various manners along the polymer chain. For example, the repeating units can be random, alternating, periodic, or block. The conditions of the polymerization reaction can be adjusted to help control the average number of repeating units (the average chain length) of the polymer. Polymer molecules can be cross-linked. As used herein, a "cross-link" and all grammatical variations thereof is a bond between two or more polymer molecules. Cross-linked polymer molecules can form a polymer network.

A polymer has an average molecular weight, which is directly related to the average chain length of the polymer. The average molecular weight of a polymer has an impact on some of the physical characteristics of a polymer; for example, its solubility, strength, and its dispersibility. For a copolymer, each of the monomers will be repeated a certain number of times (number of repeating units). The average molecular weight ($M_w$) for a copolymer can be expressed as follows:

$$M_w=\Sigma w_x M_x$$

where $w_x$ is the weight fraction of molecules whose weight is $M_x$.

The polymer can be any polymer that swells in the presence of carbon dioxide. Carbon-swelling polymers can possess a low glass transition temperature (e.g., less than −55° C. (−67° F.)), a moderate polarity, and a low molecular weight (e.g., less than 300,000). The polymer can be an elastomer. An elastomer is a natural or synthetic polymer that possesses elastic properties. A common example of an elastomer is rubber. The polymer can be polychloroprene or acrylonitrile butadiene rubber. The polymer can also be an amine-based polymer. The amine can be an organic or inorganic polyamine or an amine oligomer. The polymer can also be an aliphatic-based polymer. An example chemical reaction for uptake of carbon dioxide by monoethanolamine is shown below as Equation 1.

$$CO_2+2HOCH_2CH_2NH_2 \leftrightarrow HOCH_2CH_2NH_3^+ + HOCH_2CH_2NHCO_2^- \quad \text{Eq. (1)}$$

The polymer can be polyethylenimine (PEI), which is a combination of an amine-based polymer and an aliphatic-based polymer and employs a reaction mechanism. The nitrogen in the PEI can link to the carbon dioxide. Thus, the carbon can be bonded at different reaction sites of polyamines. Other carbon-swelling polymers include, without limitation, monoethanolamine (MEA), diethanolamine (DEA), diisopropylamine, tetraethylenepentamine (TEPA), dodecylamine, 3-aminopropyltriethoxysilane, tris(2-aminoethyl)amine, aziridine, and poly(l-lysine). These amines can react with carbon dioxide through the presence of primary, secondary, and/or tertiary amino groups. The water content in the wellbore can influence the reaction site; for example, tertiary amine reactions are more likely to occur with higher water content. Some polymers may not be capable of swelling in the presence of carbon dioxide gas. Therefore, the methods can further include combining water with the carbon dioxide above ground or within the wellbore. Water is polar and can disassociate carbon dioxide, which is non-polar, into carbonic acid. The polymer can also swell in the presence of carbonic acid, which is considered a mixture of carbon dioxide and a water-based fluid.

In addition to swelling, the sealing element can also withstand wellbore pressures and maintain structural integrity in the wellbore. The sealing element can be capable of withstanding a specified pressure. As used herein, the term "withstand" and all grammatical variations thereof, means without losing structural integrity; for example, without losing the component's sealing capability. The sealing element can be capable of withstanding pressures in the range of about 100 to about 15,000 pounds force per square inch (psi). According to any of the embodiments, the carbon-swelling polymer can be selected such that the sealing element is capable of withstanding a specified pressure and structural integrity is maintained in an acidic environment. Polar polymers, such as polychloroprene, are considered compatible in aqueous and acidic environments.

The degree of cross-linking of the polymer can affect the characteristics of the polymer. By way of example, the lower the degree of cross-linking, the greater volume of expansion that can occur. By way of another example, a lower degree of cross-linking can decrease the strength and overall structural integrity of the sealing element. According to any of the embodiments, the degree of cross-linking of the polymer is selected such that the sealing element swells a desired volume in carbon dioxide.

The polymer can have a high degree of cross-linking. According to certain embodiments, the polymer does not form a large, cross-linked polymer network. Large polymer networks can prevent the polymer from swelling the desired volume. The polymer can also be uncross-linked or have a low degree of cross-linking. Low molecular weight, liquid polymers can be cross-linked to form a solid. According to these embodiments, the sealing element can further include a filler or other compound that provides increased strength or changes the properties of the sealing element. By way of example, an uncross-linked polymer can be included in the sealing element (which can provide the desired volume of expansion) and a highly cross-linked polymer can be included in the sealing element (which can provide the desired strength and structural integrity). The continuous phase of the sealing element can be made from a stronger polymer and the discontinuous phase can be made of a carbon-swellable polymer. Combinations of fillers and different polymers with different degrees of cross-linking can be included in the sealing element to provide the desired volume of expansion and strength.

Combinations of materials can also be used depending on whether water is present in the wellbore, the wellbore temperature, and the wellbore pressures. For example, a filler can be included in the sealing element via compounding or as a surface coating, for example, to promote absorption of water in the sealing element. The filler can be hygroscopic and can include, without limitation, silica (including mesoporous silica, amorphous silica, silica sheets, and granules), nanotubes, alumina, zeolite, carbon (including nanotubes, graphene, and activated carbon), silicates (including aluminosilicate, clay, halloysite nanotubes, and bentonite), cellulose, metal (including titinate nanotubes), microporous resin, glycol (including polyethylene glycol), and metal-based materials or metal-organic framework materials, which are discussed in more detail below.

The amount of carbon captured by the polymeric sealing element can vary, in part, depending on the materials used to make the sealing element, the wellbore temperature, and the wellbore hydrostatic pressure. By way of example, depending on the wellbore conditions, PEI can capture between 5% to 30% by weight of carbon dioxide. The selection of the materials (e.g., the exact polymers used and fillers or other compounds), the degree of cross-linking, and the concentrations of the materials can be selected to provide the desired % weight (% wt) of carbon dioxide captured, including carbon dioxide in water, the desired volume of swelling, and the desired strength of the sealing element.

Another example of a carbon-swelling material that can be included in the sealing element is a metal-based material. The metal-based material can include a compound that includes a framework comprising metal nodes that are linked by organic ligand bridges. Examples of metals for the metal-based material include, but are not limited to, magnesium, iron, calcium, aluminum, tin, zinc, beryllium, barium, manganese, or any combination thereof. Preferred metals include magnesium, iron, calcium, and aluminum.

The metal-based material can include a metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin. It is to be understood that use of the term "metal" is meant to include pure metals and metal alloys. Examples of suitable metal alloys for the metal-based material include, but are not limited to, any alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. The non-metal elements of the metal alloy can include, but are not limited to, graphite, carbon, silicon, and boron nitride.

The metal-based material can uptake carbon dioxide through a chemical reaction wherein the carbon dioxide is captured in the sealing element and the sealing element swells. The metal-based material can uptake carbon dioxide through a process of mineral carbonation. Metal silicates are one example of a material that can be used to uptake carbon dioxide through mineral carbonation. The metal silicate can be, for example, magnesium silicate ($Mg_2SiO_4$), iron silicate ($Fe_2SiO_4$), or carbon silicate ($CaSiO_3$). The silicate can include an olivine mineral (a magnesium iron silicate) or a serpentine mineral. The silicate can also be mafic or ultramafic. Ultramafic minerals generally have a lower silica content and higher mineral content than mafic minerals. Equations 2-4 below show the mineral carbonation reactions of a representative metal silicate with carbon dioxide gas and optionally water.

$$(Mg,Fe)_2SiO_4+2CO_2 \rightarrow 2(Mg,Fe)CO_3+SiO_2 \quad \text{Eq. (2)}$$

$$6Mg_2SiO_4+4H_2O+6CO_2 \rightarrow 2Mg_3Si_2O_5(OH)_4+6MgCO_3+2SiO_2 \quad \text{Eq. (3)}$$

$$(Mg,Fe)_3Si_2O_5(OH)_4+3CO_2 \rightarrow 3(Mg,Fe)CO_3+2SiO_2+2H_2O \quad \text{Eq. (4)}$$

Metal silicates can uptake more carbon dioxide compared to some carbon-swelling polymeric materials. By way of example, metal silicates can uptake 100% wt of carbon dioxide. With a high $CO_2$ activity, equation 2 is the reaction that is most likely to occur and will form magnesite with no serpentine. Examining equation 2 for magnesium silicate, it can be seen that reacting one mol of magnesium silicate with carbon dioxide requires 37 cc of the carbon-swelling metal silicate and yields 56 cc of magnesium carbonate and 45 cc of silicon dioxide. Accordingly, there is a 270% volumetric expansion of the carbon-swelling material.

Other metal-based materials that are carbon swelling include not only the silicates but also zirconates (e.g., lithium zirconate having a 13% wt uptake), aluminates (e.g., lithium aluminate), oxides (e.g., lithium oxide having a 140% wt uptake and calcium oxides having a 19% wt uptake), and hydroxides (e.g., calcium hydroxide having a 33% uptake, magnesium silicate hydroxide, and sodium hydroxide). The metal-based material can be selected to provide the desired carbon uptake and swelling.

Figure 3:
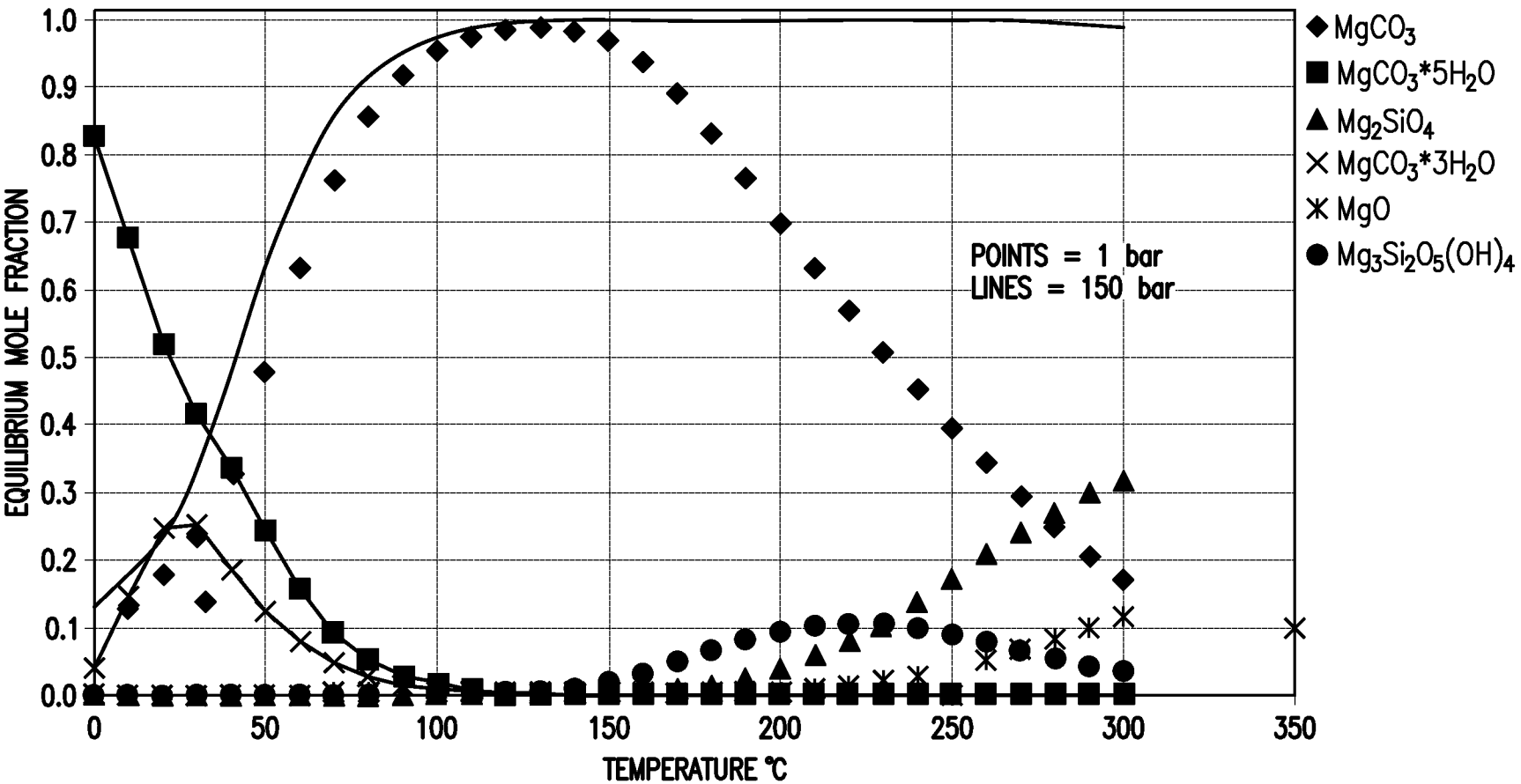
FIG. 3 is a graph showing the equilibrium mole fraction of mineral carbonation with a metal-based material versus temperature.

FIG. 3 is a graph showing the equilibrium form a metal-based material can change into other forms with a change in temperature. As can be seen in FIG. 3, the metal-based material can uptake carbon at a wide range of temperatures and hydrostatic pressure and the equilibrium form can change to compensate for temperature and pressure changes in the wellbore.

Another example of a metal-based material that can be included in the sealing element is a metal-organic framework material. A "metal-organic framework material" is an inorganic-organic hybrid material that is composed of metal ion clusters or metal ions and organic bridging ligands. The carbon dioxide uptake of metal-based materials can depend on wellbore temperatures. Compared to carbon-swelling polymers, a metal-organic framework material can uptake more $CO_2$ at lower temperatures. Accordingly, the volume of expansion of the sealing element at lower temperatures can be much greater with metal-organic framework materials than with polymeric materials. By way of example, a metal-organic framework material known as UMCM-1-NH2-MA is a University of Michigan Crystalline Material where multiple organic ligands are synthesized under solvothermal conditions with two different pore channels. The free —$NH_2$ functionality of the organic component is available to react with alkyl anhydride to form the corresponding amide functionality, which increases moisture stability and $CO_2$ adsorption. UMCM-1-NH2-MA absorbs 2% wt carbon dioxide at 18 bar at 25° C. Another metal-organic framework material based on a porous coordination network and known as PCN-5 uptakes 21% wt of $CO_2$ at 1 bar at −78° C. According to any of the embodiments, the metal-organic framework material has a high surface area to mass ratio. For example, the material can have a surface area determination with the Brunauer-Emmet-Teller (BET) method greater than 1 $m^2$ per gram or preferably greater than 100 $m^2$ per gram.

As mentioned previously regarding the discussion of carbon-swelling polymeric materials, the sealing element can include more than one type of carbon-swelling material as well as binders, fillers, or other compounds. By way of example, the continuous phase of the sealing element can be made from a carbon-swelling polymer, a polymer that does not swell in the presence of carbon dioxide, combinations of swellable and non-swellable polymers, and a discreet phase of the metal-based material. In this manner, the sealing element can be designed to uptake and capture a desired amount of carbon in a variety of temperatures and pressures, swell the desired volume, and maintain the desired strength and structural integrity. One non-limiting example includes a combination of a metal-based material and polymers such that there is a consistent volumetric expansion over a wide range of temperatures by using the negative temperature coefficient of the metal-organic framework material and the positive temperature coefficient of the polymers.

The methods include contacting the sealing element with carbon dioxide. The carbon dioxide can be located within a subterranean formation or the wellbore. The carbon dioxide can be part of a formation fluid. The carbon dioxide can contact the sealing element during production of the formation fluid for example. The formation fluid can also include water. The carbon dioxide can react with the water to form carbonic acid. Depending on the carbon-swelling material included in the sealing element, the sealing element can swell in the presence of carbonic acid.

The carbon dioxide can also be injected into the wellbore. The carbon dioxide for injection can be in a gas phase, a liquid phase, or a supercritical liquid phase. The carbon dioxide can also be injected into the wellbore in a carrier fluid. The carrier fluid can include water and other components. The injection fluid, which includes the carbon dioxide and possibly carbonic acid if water is present, can contact the sealing element. In this manner, carbon dioxide can be captured by the sealing element and prevented from being released into the atmosphere.

The methods can also include retrieving the downhole tool; for example, the packer assembly. The downhole tool or select components of the downhole tool can be milled. By way of another example, the sealing element can be caused or allowed to at least partially convert to a pre-swelled state. The downhole tool can then be retrieved from the wellbore with a retrieval tool, such as a fishing tool, for example. One example of at least partially converting the sealing element to a pre-swelled state can include increasing the temperature in the area adjacent to the sealing element. By way of example, heating PEI above a threshold temperature results in the release of at least some of the captured carbon, which causes the sealing element to decrease in volume and allows the downhole tool to be retrievable. The threshold temperature varies with the form of the PEI, the water content of the environment, and the hydrostatic pressure, and can range from 45° C. to 200° C. (113° F. to 392° F.).

An embodiment of the present disclosure is a method of capturing carbon in a subterranean formation comprising: installing a sealing element in a wellbore that penetrates the subterranean formation, wherein the sealing element swells in the presence of carbon dioxide; and contacting the sealing element with carbon dioxide. Optionally, the method further comprises wherein the sealing element is part of a packer assembly, a downhole tool, or a plug, and wherein the sealing element creates a seal, forms an anchor, or creates a seal and forms an anchor within the wellbore after contacting the sealing element with carbon dioxide. Optionally, the method further comprises wherein the sealing element swells in a range of 20% to 300% in volume. Optionally, the method further comprises wherein the sealing element swells a sufficient volume such that the sealing element creates the seal by engaging with an inner diameter of a tubing string, casing, or wellbore wall after the sealing element is contacted with the carbon dioxide, whereby fluid is prevented or substantially restricted from flowing past the sealing element. Optionally, the method further comprises wherein the sealing element comprises a carbon-swellable polymer. Optionally, the method further comprises wherein the carbon-swellable polymer is an elastomer. Optionally, the method further comprises wherein the carbon-swellable polymer is selected from rubber, an amine-based polymer, or an aliphatic-based polymer. Optionally, the method further comprises wherein the carbon-swellable polymer is selected from the group consisting of polychloroprene rubber, acrylonitrile butadiene rubber, polyethylenimine, monoethanolamine, diethanolamine, diisopropylamine, tetraethylenepentamine, dodecylamine, 3-aminopropyltriethoxysilane, tris(2-aminoethyl)amine, aziridine, poly(l-lysine), and combinations thereof. Optionally, the method further comprises wherein the carbon-swellable polymer is an uncross-linked polymer or has a low degree of cross-linking. Optionally, the method further comprises wherein the sealing element further comprises a non-carbon-swellable polymer, a filler, or combinations thereof. Optionally, the method further comprises wherein the sealing element comprises a metal-based material, wherein the metal-based material is a compound comprising a framework and metal nodes that are linked together by organic ligand bridges. Optionally, the method further comprises wherein a metal of the metal-based material is selected from the group consisting of magnesium, iron, calcium, aluminum, tin, zinc, beryllium, barium, manganese, alloys of any of the foregoing, and combinations thereof. Optionally, the method further comprises wherein the metal-based material is selected from metal silicates, metal zirconates, metal aluminates, metal oxides, or metal hydroxides. Optionally, the method further comprises wherein the metal-based material is a metal-organic framework material. Optionally, the method further comprises wherein the sealing element further comprises a continuous phase of an elastomeric material and a discreet phase of the metal-based material in the form of particles. Optionally, the method further comprises wherein the elastomeric material is a carbon-swellable polymer, a non-carbon-swellable polymer, or combinations thereof. Optionally, the method further comprises wherein the sealing element withstands pressures in the range of 100 to 15,000 pounds force per square inch. Optionally, the method further comprises wherein a subterranean formation fluid comprises the carbon dioxide or an injection fluid comprises the carbon dioxide.

Another embodiment of the present disclosure is a well system comprising: a wellbore that penetrates a subterranean formation; a tubing string located within the wellbore; and a sealing element located adjacent to the tubing string, wherein the sealing element swells in the presence of carbon dioxide. Optionally, the well system further comprises wherein the sealing element is part of a packer assembly, a downhole tool, or a plug, and wherein the sealing element creates a seal, forms an anchor, or creates a seal and forms an anchor within the wellbore after contacting the sealing element with carbon dioxide. Optionally, the well system further comprises wherein the sealing element swells in a range of 20% to 300% in volume. Optionally, the well system further comprises wherein the sealing element swells a sufficient volume such that the sealing element creates the seal by engaging with an inner diameter of a tubing string, casing, or wellbore wall after the sealing element is contacted with the carbon dioxide, whereby fluid is prevented or substantially restricted from flowing past the sealing element. Optionally, the well system further comprises wherein the sealing element comprises a carbon-swellable polymer. Optionally, the well system further comprises wherein the carbon-swellable polymer is an elastomer. Optionally, the well system further comprises wherein the carbon-swellable polymer is selected from rubber, an amine-based polymer, or an aliphatic-based polymer. Optionally, the well system further comprises wherein the carbon-swellable polymer is selected from the group consisting of polychloroprene rubber, acrylonitrile butadiene rubber, polyethylenimine, monoethanolamine, diethanolamine, diisopropylamine, tetraethylenepentamine, dodecylamine, 3-aminopropyltriethoxysilane, tris(2-aminoethyl)amine, aziridine, poly(l-lysine), and combinations thereof. Optionally, the well system further comprises wherein the carbon-swellable polymer is an uncross-linked polymer or has a low degree of cross-linking. Optionally, the well system further comprises wherein the sealing element further comprises a non-carbon-swellable polymer, a filler, or combinations thereof. Optionally, the well system further comprises wherein the sealing element comprises a metal-based material, wherein the metal-based material is a compound comprising a framework and metal nodes that are linked together by organic ligand bridges. Optionally, the well system further comprises wherein a metal of the metal-based material is selected from the group consisting of magnesium, iron, calcium, aluminum, tin, zinc, beryllium, barium, manganese, alloys of any of the foregoing, and combinations thereof. Optionally, the well system further comprises wherein the metal-based material is selected from metal silicates, metal zirconates, metal aluminates, metal oxides, or metal hydroxides. Optionally, the well system further comprises wherein the metal-based material is a metal-organic framework material. Optionally, the well system further comprises wherein the sealing element further comprises a continuous phase of an elastomeric material and a discreet phase of the metal-based material in the form of particles. Optionally, the well system further comprises wherein the elastomeric material is a carbon-swellable polymer, a non-carbon-swellable polymer, or combinations thereof. Optionally, the well system further comprises wherein the sealing element withstands pressures in the range of 100 to 15,000 pounds force per square inch. Optionally, the well system further comprises wherein a subterranean formation fluid comprises the carbon dioxide or an injection fluid comprises the carbon dioxide.

Another embodiment of the present disclosure is a downhole tool comprising: a mandrel; and a sealing element located adjacent to the mandrel, wherein the sealing element swells in the presence of carbon dioxide. Optionally, the downhole tool further comprises wherein the sealing element is part of a packer assembly, a downhole tool, or a plug, and wherein the sealing element creates a seal, forms an anchor, or creates a seal and forms an anchor within the wellbore after contacting the sealing element with carbon dioxide. Optionally, the downhole tool further comprises wherein the sealing element swells in a range of 20% to 300% in volume. Optionally, the downhole tool further comprises wherein the sealing element swells a sufficient volume such that the sealing element creates the seal by engaging with an inner diameter of a tubing string, casing, or wellbore wall after the sealing element is contacted with the carbon dioxide, whereby fluid is prevented or substantially restricted from flowing past the sealing element. Optionally, the downhole tool further comprises wherein the sealing element comprises a carbon-swellable polymer. Optionally, the downhole tool further comprises wherein the carbon-swellable polymer is an elastomer. Optionally, the downhole tool further comprises wherein the carbon-swellable polymer is selected from rubber, an amine-based polymer, or an aliphatic-based polymer. Optionally, the downhole tool further comprises wherein the carbon-swellable polymer is selected from the group consisting of polychloroprene rubber, acrylonitrile butadiene rubber, polyethylenimine, monoethanolamine, diethanolamine, diisopropylamine, tetraethylenepentamine, dodecylamine, 3-aminopropyltriethoxysilane, tris(2-aminoethyl)amine, aziridine, poly(l-lysine), and combinations thereof. Optionally, the downhole tool further comprises wherein the carbon-swellable polymer is an uncross-linked polymer or has a low degree of cross-linking. Optionally, the downhole tool further comprises wherein the sealing element further comprises a non-carbon-swellable polymer, a filler, or combinations thereof. Optionally, the downhole tool further comprises wherein the sealing element comprises a metal-based material, wherein the metal-based material is a compound comprising a framework and metal nodes that are linked together by organic ligand bridges. Optionally, the downhole tool further comprises wherein a metal of the metal-based material is selected from the group consisting of magnesium, iron, calcium, aluminum, tin, zinc, beryllium, barium, manganese, alloys of any of the foregoing, and combinations thereof. Optionally, the downhole tool further comprises wherein the metal-based material is selected from metal silicates, metal zirconates, metal aluminates, metal oxides, or metal hydroxides. Optionally, the downhole tool further comprises wherein the metal-based material is a metal-organic framework material. Optionally, the downhole tool further comprises wherein the sealing element further comprises a continuous phase of an elastomeric material and a discreet phase of the metal-based material in the form of particles. Optionally, the downhole tool further comprises wherein the elastomeric material is a carbon-swellable polymer, a non-carbon-swellable polymer, or combinations thereof. Optionally, the downhole tool further comprises wherein the sealing element withstands pressures in the range of 100 to 15,000 pounds force per square inch. Optionally, the downhole tool further comprises wherein a subterranean formation fluid comprises the carbon dioxide or an injection fluid comprises the carbon dioxide.

Therefore, the various embodiments are well adapted to attain the ends and advantages mentioned as well as those that are inherent therein. The particular embodiments disclosed above are illustrative only, as the various embodiments may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more zones, sealing elements, etc., as the case may be, and do not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A method of capturing carbon in a subterranean formation comprising:

installing a sealing element in a wellbore that penetrates the subterranean formation, wherein the sealing element swells in the presence of carbon dioxide, and wherein the sealing element comprises a metal-based material, wherein the metal-based material is selected from metal silicates, metal zirconates, or metal aluminates;

contacting the sealing element with carbon dioxide; and causing or allowing the sealing element to increase in volume through a combination of adsorption of carbon dioxide and a chemical reaction between the metal-based material and carbon dioxide.

2. The method according to claim 1, wherein the sealing element is part of a packer assembly, a downhole tool, or a plug, and wherein the sealing element creates a seal, forms an anchor, or creates a seal and forms an anchor within the wellbore after contacting the sealing element with carbon dioxide.

3. The method according to claim 1, wherein the sealing element swells in a range of 20% to 300% in volume.

4. The method according to claim 1, wherein the sealing element swells a sufficient volume such that the sealing element creates the seal by engaging with an inner diameter of a tubing string, casing, or wellbore wall after the sealing element is contacted with the carbon dioxide, whereby fluid is prevented or substantially restricted from flowing past the sealing element.

5. The method according to claim 1, wherein the sealing element comprises a carbon-swellable polymer.

6. The method according to claim 5, wherein the carbon-swellable polymer is an elastomer.

7. The method according to claim 5, wherein the carbon-swellable polymer is selected from rubber, an amine-based polymer, or an aliphatic-based polymer.

8. The method according to claim 7, wherein the carbon-swellable polymer is selected from the group consisting of polychloroprene rubber, acrylonitrile butadiene rubber, polyethylenimine, monoethanolamine, diethanolamine, diisopropylamine, tetraethylenepentamine, dodecylamine, 3-aminopropyltriethoxysilane, tris(2-aminoethyl)amine, aziridine, poly(l-lysine), and combinations thereof.

9. The method according to claim 5, wherein the carbon-swellable polymer is an uncross-linked polymer.

10. The method according to claim 5, wherein the sealing element further comprises a non-carbon-swellable polymer, a filler, or combinations thereof.

11. The method according to claim 1, wherein a metal of the metal-based material is selected from the group consisting of magnesium, iron, calcium, aluminum, tin, zinc, beryllium, barium, manganese, alloys of any of the foregoing, and combinations thereof.

12. The method according to claim 1, wherein the metal-based material is a metal-organic framework material.

13. The method according to claim 1, wherein the sealing element further comprises a continuous phase of an elastomeric material and a discreet phase of the metal-based material in the form of particles.

14. The method according to claim 13, wherein the elastomeric material is a carbon-swellable polymer, a non-carbon-swellable polymer, or combinations thereof.

15. The method according to claim 1, wherein the sealing element withstands pressures in the range of 100 to 15,000 pounds force per square inch.

16. The method according to claim 1, wherein a subterranean formation fluid comprises the carbon dioxide or an injection fluid comprises the carbon dioxide.

17. A well system comprising:

a wellbore that penetrates a subterranean formation;

a tubing string located within the wellbore; and a sealing element located adjacent to the tubing string, wherein the sealing element swells in the presence of carbon dioxide, and wherein the sealing element comprises a metal-based material, wherein the metal-based material is selected from metal silicates, metal zirconates, or metal aluminates, and wherein the sealing element is configured to increase in volume through a combination of adsorption of carbon dioxide and a chemical reaction between the metal-based material and carbon dioxide.

18. The well system according to claim 17, wherein the sealing element further comprises a continuous phase of an elastomeric material and a discreet phase of the metal-based material in the form of particles, and wherein the elastomeric material is a carbon-swellable polymer, a non-carbon-swellable polymer, or combinations thereof.

19. A downhole tool comprising:

a mandrel; and a sealing element located adjacent to the mandrel, wherein the sealing element swells in the presence of carbon dioxide, and wherein the sealing element comprises a metal-based material, wherein the metal-based material is selected from metal silicates, metal zirconates, or metal aluminates, and wherein the sealing element is configured to increase in volume through a combination of adsorption of carbon dioxide and a chemical reaction between the metal-based material and carbon dioxide.

20. The downhole tool according to claim 19, wherein the sealing element further comprises a continuous phase of an elastomeric material and a discreet phase of the metal-based material in the form of particles, and wherein the elastomeric material is a carbon-swellable polymer, a non-carbon-swellable polymer, or combinations thereof.

* * * * *